US005658367A

United States Patent [19]

Jackman et al.

[11] Patent Number: 5,658,367

[45] Date of Patent: Aug. 19, 1997

[54] METHOD OF MANUFACTURING MAGNESIUM POWDER FROM MAGNESIUM CROWN

[75] Inventors: Joseph R. Jackman; Leon A. Luyckx; Jeffrey S. Gill, all of New Castle, Pa.

[73] Assignee: Reactive Metals & Alloys Corporation, West Pittsburg, Pa.

[21] Appl. No.: 528,149

[22] Filed: Sep. 14, 1995

[51] Int. Cl.[6] ..... B22F 9/04

[52] U.S. Cl. ..... 75/357; 75/367

[58] Field of Search ..... 75/354, 357, 367; 241/30

[56] References Cited

U.S. PATENT DOCUMENTS

| | | | |
|---|---|---|---|
| 1,594,346 | 8/1926 | Bakken | 420/402 |
| 1,814,072 | 7/1931 | Bakken | 75/590 |
| 2,231,023 | 2/1941 | Nelson | 75/409 |
| 2,257,910 | 10/1941 | Kirk | 75/367 |
| 2,332,277 | 10/1943 | Stern | 75/403 |
| 3,033,549 | 5/1962 | Ash | 266/153 |
| 3,268,219 | 8/1966 | Peplinski | 266/19 |
| 3,294,385 | 12/1966 | Peplinski | 266/19 |
| 4,290,804 | 9/1981 | Avery | 75/595 |
| 4,351,484 | 9/1982 | Hart | 241/30 |
| 4,428,771 | 1/1984 | Nowak | 75/407 |
| 4,543,122 | 9/1985 | Bodenstein et al. | 75/367 |

FOREIGN PATENT DOCUMENTS

| | | | |
|---|---|---|---|
| 63-125603 | 5/1988 | Japan | 75/354 |
| 6-88148 | 3/1994 | Japan . | |

OTHER PUBLICATIONS

L. M. Pidgeon and W. A. Alexander, "Thermal Production of Magnesium–Pilot Plant Studies on the Retort, Ferrosilicon Process," *Transactions of AIME,* vol. 159, 1944.

W. B. Humes, "Vacuum Engineering as Related to the Deolomite Ferrosilicon Process," *Transactions of AIME,* vol. 159, 1944.

A Mayer, "Plant for Production of Magnesium by the Ferrosolicon Process," *Transactions of AIME,* vol. 159, 1944.

W. M. Pierce et al., "Some Developments in the Production of Magnesium from Dolomite by the Ferrosilicon Process," *Transactions of AIME,* vol. 159, 1944.

"The Pidgeon Process" Principles of Magnesium Technology, pp. 52–58, 68.

*Primary Examiner*—George Wyszomierski

*Attorney, Agent, or Firm*—Buchanan Ingersoll, P.C.

[57] ABSTRACT

Magnesium powder is manufactured by reacting dolomitic lime, ferrosilicon and fluorospar to create magnesium vapor. The magnesium vapor is condensed in a retort in a manner to form a primarily dendritic crown of magnesium. The dendritic magnesium crown is shredded into magnesium particles which are then crushed into magnesium powder through conventional milling or grinding equipment.

6 Claims, 2 Drawing Sheets

METHOD OF MANUFACTURING MAGNESIUM POWDER FROM MAGNESIUM CROWN

BACKGROUND OF THE INVENTION

The invention relates to the manufacture of magnesium powder from magnesium crowns produced from the pigeon process.

DESCRIPTION OF THE PRIOR ART

Magnesium powder is particularly important as a desulfurizer in the manufacture of steel. Magnesium powder is traditionally obtained by chipping and grinding ingots of pure magnesium and its alloys. A particle size of less than 20 mesh is often preferred for magnesium powder used as a desulfurizer.

One method of manufacturing pure magnesium is known as the pidgeon process. In this process raw dolomite and ferrosilicon are heated in a retort furnace under vacuum. Magnesium vapor is formed and condensed within a condensation cylinder or sleeve at the cooling end of each of the retorts which extend from the furnace. A water jacket is provided at the cooling end of the retort and the sleeve within the retort. Water flowing through the water jacket sufficiently cools the condenser portion of the retort to allow the magnesium vapor to condense on the condenser thereby forming a solid magnesium formation referred to as the "crown." These crowns are solid, dense structures typically weighing between 40 and 70 pounds depending on the size of the retort. The crowns are removed from the retort, remelted and then cast into ingots. If powdered magnesium is needed the ingots are processed through a chipping machine and then the chips are ground into powder by being passed through a hammer mill. During the traditional process of remelting the crown and casting the remelted magnesium into an ingot, typically 5 to 15% of the magnesium is lost through oxidation. When a solid, dense crown is remelted and cast into an ingot, only about 5% of the magnesium will be lost during the remelting and casting process. If a very loose crown is formed, remelting and cast, as much as 15% of the metal is lost during the remelting process. Therefore, loose crowns are considered to be undesirable and it has been standard practice in the industry to form solid, dense crowns and then remelt and cast those crowns into ingots.

We have calculated that the loss of metal during remelting and casting is approximately 11 cents per pound of final metal produced. Labor costs are usually 15 cents per pound and another 10 cents per pound for fuel and furnace shop-overhead expenses are incurred during the remelting and casting process. Therefore, a very significant savings of approximatley 36 cents per pound can be obtained by directly converting magnesium crowns to powder without remelting. Yet, because of the density of the crowns desired in the pidgeon process for the production of primary magnesium ingots, the art has not considered it practical to produce magnesium powder from a magnesium crown without remelting the crown into an ingot. Consequently, the art continues to remelt magnesium crowns into ingots before the metal is converted into powder by chipping or milling and then crushing the chips by hammer milling.

It is known in the art that magnesium vapor can be condensed to form a loose crystalline or dendritic structure. For example in U.S. Pat. No. 2,231,023 Nelson discloses a method of condensing magnesium vapor on the cold surface of a condenser to form magnesium crystals. These crystals are then stripped from the condenser for further processing. Nelson further teaches that the crystals can be formed at temperatures between about 500° to 800° C. depending on the amount of vacuum employed. At 0.05 millimeters pressure of mercury, a temperature of 700° C. is said to be highly satisfactory. The patent teaches that 3 to 4 pounds of magnesium per hour arc produced at this temperature and pressure. Kirk in U.S. Pat. No. 2,257,910 teaches that magnesium crystals can be formed by condensing magnesium vapor at absolute pressures below 100 millimeters of mercury and at a surface temperature of above about 300° C. He likewise teaches that magnesium condensate is obtained largely as relatively coarse crystals which are scraped from the condensation surface. The crystalline structures formed by Kirk and Nelson are substantially smaller in weight than the magnesium crowns weighing typically in excess of 40 pounds that are produced using the pidgeon process. These crystals are much easier to handle and process because of their small size.

Despite the knowledge that magnesium vapor can be condensed into crystalline structures the art has failed to recognize that large dendritic magnesium crowns can be formed using the pidgeon process and that such crowns can be directly converted into magnesium powder without remelting. This, therefore, makes the pidgeon process a much more viable commercial process for the production of magnesium powder than heretofore was otherwise thought.

SUMMARY OF THE INVENTION

Magnesium powder is manufactured by reacting dolomite and ferrosilicon to create magnesium vapor. The magnesium vapor is condensed into a solid mass in the condenser portion of a retort on which a vacuum is drawn. The condenser portion of the retort is cooled to condense the magnesium vapor in a manner to form a primarily dendritic growth of magnesium crystals. This dendritic mass or magnesium crown is crushed or shredded into small magnesium particles which are then crushed into magnesium powder by conventional hammer milling.

DESCRIPTION OF THE PREFERRED EMBODIMENTS

Figure 1:
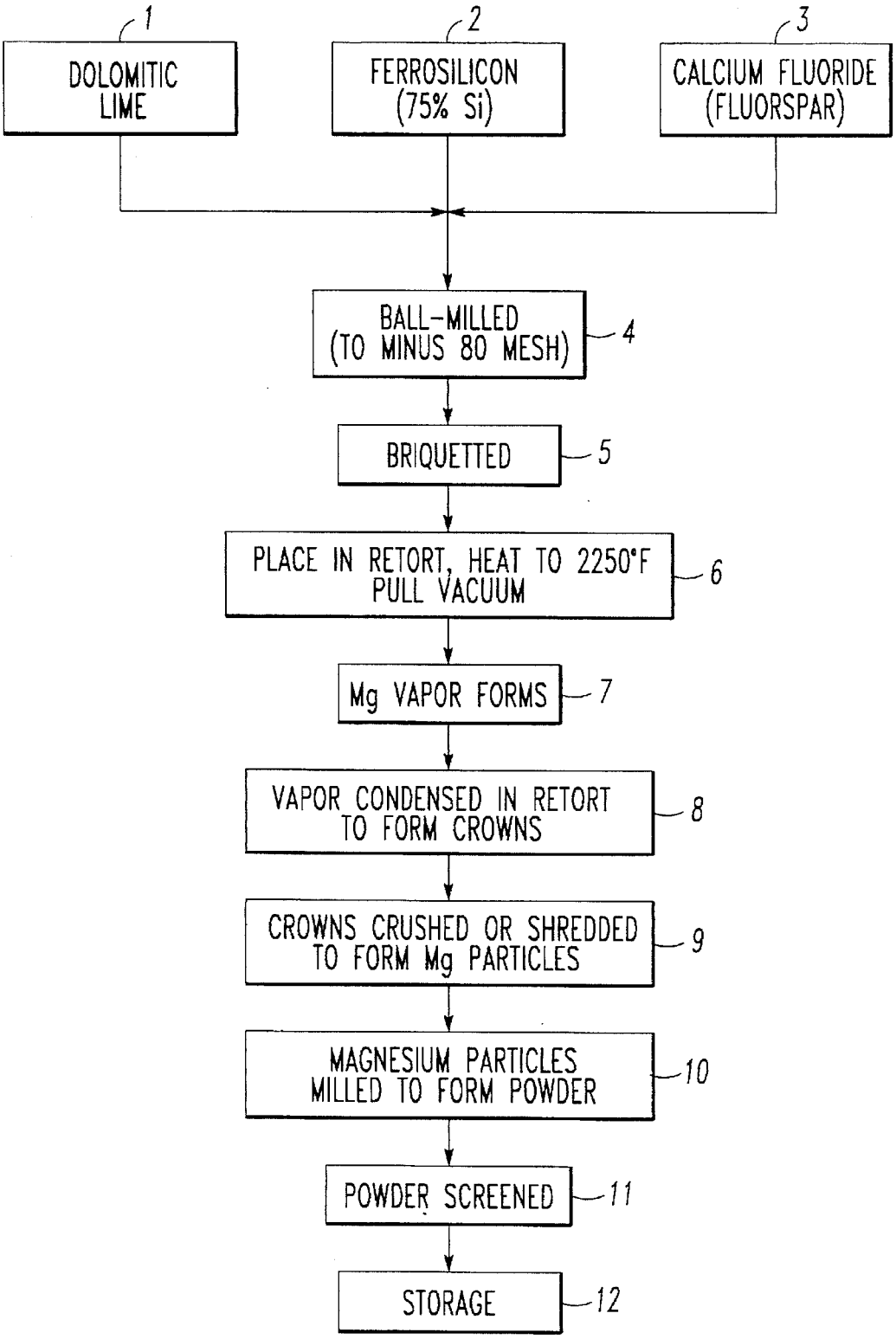
FIG. 1 is a flow chart illustrating the present preferred method of manufacturing magnesium powder.

The present method utilizes dendritic magnesium crowns that have preferably been formed in a furnace and retort system of the type used for the pidgeon process. Referring to FIG. 1, crushed raw dolomitic lime 1, ferrosilicon powder 2 and calcium fluoride 3 are ball-milled 4 and briquetted 5. The briquettes are placed in a retort which is heated and under vacuum 6. We prefer to heat the retort to 2250° F. Magnesium vapor forms 7. The magnesium vapor is condensed in retorts to form dendritic magnesium crowns 8. The temperature and pressure of the retorts are controlled so that the magnesium vapor condenses in the retort forming loose dendritic structures each of which typically weighs between 40 and 50 pounds. The crowns are then removed from the retort and crashed or shredded into magnesium particles. 9. We prefer to use a primary and at least one secondary shredder or crusher. These magnesium particles are then milled to form magnesium powder 10 through conventional magnesium grinding processes. The powder is preferably passed through one or more screens 11 to segregate less than 20 mesh powder. That powder is then stored 12 in bins, bags or other containers.

Figure 2:
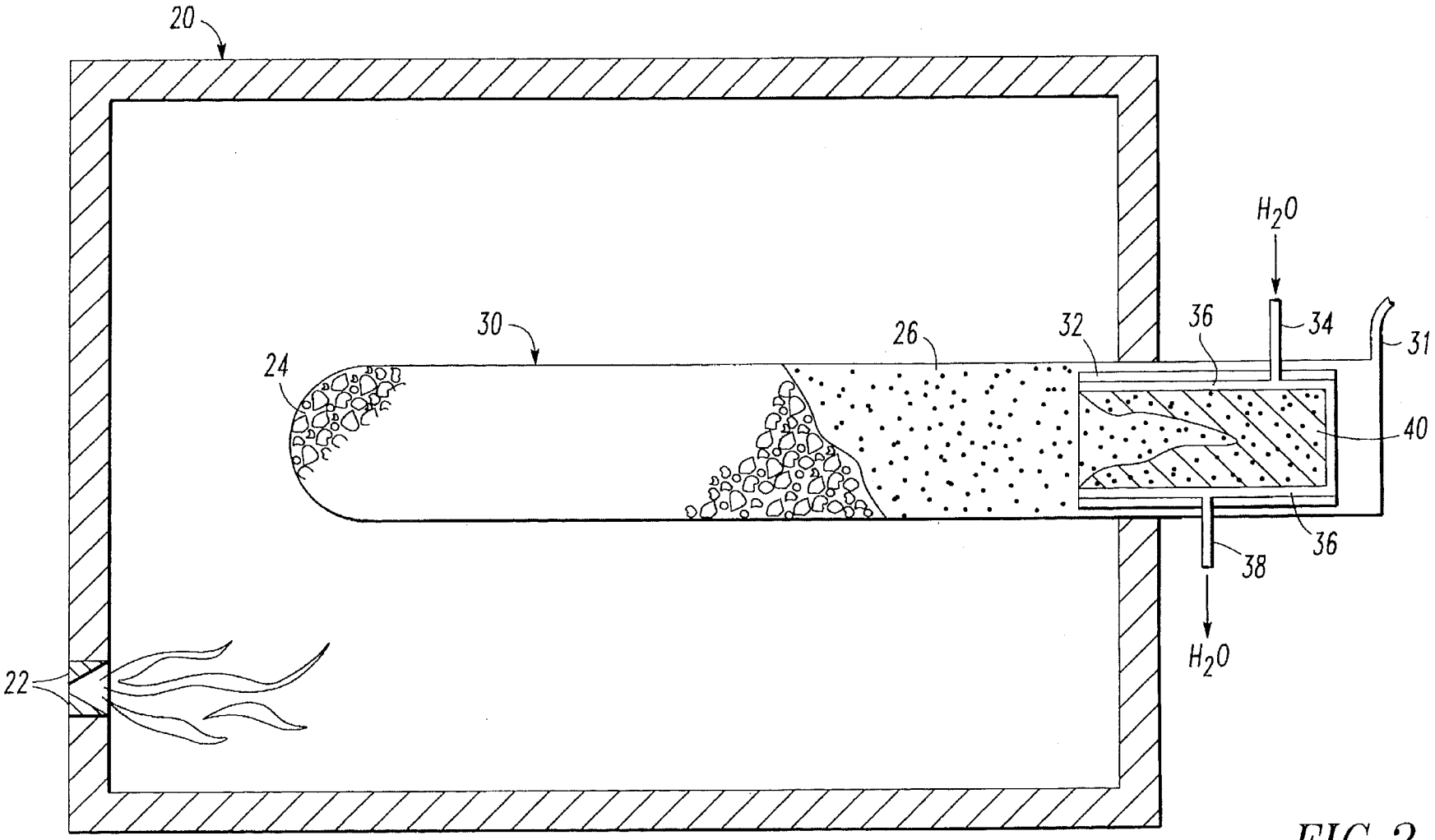
FIG. 2 is a cross-sectional view showing a general arrangement of a furnace and water cooled retort useful for producing dendritic crowns required for the present method.

The magnesium crowns typically will be formed in a furnace and retort such as is shown in FIG. 2 and then be transferred to another location for conversion into powder. In the furnace 20 shown in FIG. 2, a charge 24 of crushed dolomite, ferrosilicon and calcium fluoride is heated in retort 30 by gas jets 22 or other heat source to form magnesium vapor 26. The temperature of the furnace must be sufficiently high to create magnesium vapor but not so high as to melt the retort 30 attached to the furnace 20. Hence, the temperature of the furnace preferably is about 2200° F. and does not exceed 2300° F. A vacuum is drawn on retort 30 through conduit 31. The magnesium vapor 26 enters a water cooled condensation cylinder or sleeve 32. A chamber or water jacket 36 surrounds the sleeve. Water flows into chamber 36 from supply pipe 34 and exits the chamber through discharge pipe 38. The water flowing through chamber 36 cools the interior of cylinder 32. The rate of cooling must be sufficient to cause the magnesium vapor to condense into a loose dendritic crystalline structure 40. The rate of cooling is determined by both the temperature of the water and the flow rate.

EXAMPLES

Thirty eight heats were run in an effort to define the best temperatures, pressures and other conditions for producing the largest dendritic crown from charges of 448 or 560 pounds of dolomite,ferrosilicon and fluorspar. Because of operational problems with the retort five of those heats were aborted. Thus, thirty three dendritic magnesium crowns were produced. In all of the heats dolomitic lime was crushed and screened to select particles sized 2 mm×6 mm or 6 mm×50 mm. The dolomitic lime was mixed with ball milled ferrosilicon and fluorspar to form a charges of 448 or 560 pounds per heat. The mix was heated at temperatures of 2200° F., 2228° F. or 2254° F. for 12 hours to form magnesium vapor. During that time period the magnesium vapor was condensed in a water cooled condenser of the type shown in FIG. 2. Flow rates of 5 gallons and 10 gallons per minute were used. A vacuum was drawn on the system at selected values within the range of 21 to 70 microns. This resulted in the formation of primarily dendritic magnesium crowns ranging in weight from 47 to 68 pounds. Table I lists crown weight of the resulting crown and produced during each heat as well as the charge weight and temperature to which the charge is heated. Generally the data shows that crowns weighing from 40 to 70 pounds can be produced. The efficiency of the conversion did not appear to be related to the vacuum level pulled on the retort. The most important factor in producing the desired dendritic crown is control of the condensation rate of the magnesium vapor. As previously stated, this rate can be controlled by adjusting the temperature and flow rate of the cooling fluid, which typcially is water, the retort design, the rate of water cooling of the condensation cylinder, the pressure of the water coolant, and the design of heat shields in the system.

The resultant magnesium crowns were comprised of a solid center weighing about 4 to 5 pounds surrounded by a loose dendritic crystalline structure. The crowns were taken to a high torque, low speed, counter-rotating knife-type shredder where the dendritic portions were easily converted into magnesium chips of approximately 20 mm in diameter. The magnesium chips were them crushed into less than 20 mesh powder in hammer mills. The powder was screened to complete the manufacturing process.

Although we have shown and &scribed certain present preferred embodiments of my method and system for practicing that method it should be distinctly understood that the invention is not limited thereto but may be variously embodied within the scope of the following claims.

TABLE I

| Heat | Charge (lbs) | Temperature (°F.) | Crown Weight (lbs) |
|---|---|---|---|
| 1 | 448 | 2254 | 54 |
| 2 | 448 | 2254 | 47 |
| 3 | 448 | 2254 | 48 |
| 5 | 448 | 2254 | 57 |
| 6 | 448 | 2250 | 50 |
| 7 | 448 | 2254 | 60 |
| 8 | 448 | 2254 | 58 |
| 11 | 449 | 2254 | 59 |
| 12 | 448 | 2254 | 58 |
| 13 | 448 | 2254 | 43 |
| 14 | 448 | 2254 | 59 |
| 15 | 448 | 2200 | 25 |
| 16 | 448 | 2200 | 42 |
| 17 | 448 | 2200 | 47 |
| 20 | 448 | 2228 | 60 |
| 21 | 448 | 2228 | 59 |
| 22 | 560 | 2228 | 68 |
| 23 | 560 | 2228 | 53 |
| 24 | 560 | 2228 | 48 |
| 25 | 560 | 2228 | 68 |
| 26 | 560 | 2228 | 60 |
| 27 | 560 | 2228 | 66 |
| 28 | 560 | 2228 | 52 |
| 29 | 560 | 2228 | 65 |
| 30 | 448 | 2228 | 41 |
| 31 | 448 | 2228 | 47 |
| 32 | 448 | 2228 | 53 |
| 33 | 448 | 2228 | 56 |
| 34 | 448 | 2228 | 59 |
| 35 | 448 | 2228 | 52 |
| 36 | 448 | 2228 | 60 |
| 37 | 448 | 2228 | 59 |
| 38 | 449 | 2228 | 62 |

We claim:

1. A method for manufacturing magnesium powder comprising the steps of:

a. heating raw dolomite and ferrosilicon in a retort under vacuum to form magnesium vapor;

b. providing a condensation cylinder within a cooling end of the retort;

c. providing a water jacket at the cooling end of the retort;

d. flowing water through the water jacket at a rate sufficient to cool the condensation cylinder so that a dendritic crown of magnesium is formed;

e. condensing the magnesium vapor under such temperature, pressure and rate of cooling as required to form a primarily dendritic crown of magnesium;

f. crushing the crown into magnesium particles; and g. milling the magnesium particles into magnesium powder.

2. The method of claim 1 wherein the magnesium vapor is condensed under a temperature within the range of 2200° F. to 2254° F.

3. The method of claim 1 wherein the magnesium powder has a size of less than 20 mesh.

4. The method of claim 1 wherein the crushing step comprises passing the magnesium crown through one of a shredder and a crusher.

5. The method of claim 1 wherein the creating step comprises heating dolomitic lime, ferrosilicon and flurospar under vacuum to form magnesium vapor.

6. The method of claim 1 wherein the magnesium crown weighs at least 40 pounds.

* * * * *

UNITED STATES PATENT AND TRADEMARK OFFICE

CERTIFICATE OF CORRECTION

PATENT NO. : 5,658,367

DATED : August 19, 1997

INVENTOR(S) : JOSEPH R. JACKMAN, LEON A. LUYCKX, JEFFREY S. GILL

It is certified that error appears in the above-indentified patent and that said Letters Patent is hereby corrected as shown below:

Column 4, Table I, line 8 in the Table, at the Column titled "Charge" change "449" to —448—.

Column 4, Table I, line 33 of the Table, at the Column titled "Charge" change "449" to —448—.

Signed and Sealed this

Twelfth Day of May, 1998

Bruce Lehman

*Attest:*

BRUCE LEHMAN

*Attesting Officer*

*Commissioner of Patents and Trademarks*